US012382985B2

(12) United States Patent
Chung et al.

(10) Patent No.: US 12,382,985 B2
(45) Date of Patent: Aug. 12, 2025

(54) VANILLA SMOKING MATERIAL WRAPPER AND SMOKING ARTICLE INCLUDING THE SAME

(71) Applicant: KT&G CORPORATION, Daejeon (KR)

(72) Inventors: Nae Oh Chung, Daejeon (KR); Ki Jin Ahn, Daejeon (KR); Chul Hee Lee, Daejeon (KR); Han Jin Kim, Daejeon (KR); Kwang Ho Cha, Daejeon (KR); Kwang Won Kang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 279 days.

(21) Appl. No.: 17/776,849

(22) PCT Filed: Jul. 2, 2021

(86) PCT No.: PCT/KR2021/008431
§ 371 (c)(1),
(2) Date: May 13, 2022

(87) PCT Pub. No.: WO2022/010190
PCT Pub. Date: Jan. 13, 2022

(65) Prior Publication Data

US 2022/0386687 A1 Dec. 8, 2022

(30) Foreign Application Priority Data

Jul. 9, 2020 (KR) ..... 10-2020-0084915

(51) Int. Cl.
*A24D 1/02* (2006.01)
*A24D 3/10* (2006.01)

(52) U.S. Cl.
CPC ..... *A24D 1/022* (2013.01); *A24D 1/025* (2013.01); *A24D 3/10* (2013.01)

(58) Field of Classification Search
CPC ..... A24D 1/02; A24D 1/022; A24D 1/025
See application file for complete search history.

(56) References Cited

U.S. PATENT DOCUMENTS 5,065,776 A 11/1991 Lawson et al.

FOREIGN PATENT DOCUMENTS

CN 106522022 A * 3/2017
DE 19957486 A1 * 6/2001 ..... A24B 15/282
(Continued)

OTHER PUBLICATIONS

DE 19957486 A1 English Translation obtained from Espacenet Apr. 9, 2024, pp. 1-16 (Year: 2024).*
(Continued)

*Primary Examiner* — Eric Yaary
(74) *Attorney, Agent, or Firm* — Sughrue Mion, PLLC

(57) ABSTRACT

A smoking material wrapper for wrapping a smoking material portion of a smoking article includes tobacco fibers and at least one vanilla material from among vanillin, ethyl vanillin, and ethyl vanillin glucoside. A smoking article includes a smoking material portion wrapped with the smoking material wrapper; a filter portion wrapped with a filter wrapper, and a tipping wrapper wrapped around the filter portion and at least a partial area of the smoking material portion such that the smoking material portion and the filter portion are combined.

6 Claims, 1 Drawing Sheet

(56) References Cited

FOREIGN PATENT DOCUMENTS

| | | | |
|---|---|---|---|
| JP | 6-7142 | A | 1/1994 |
| JP | 2003-530827 | A | 10/2003 |
| KR | 10-1105013 | B1 | 1/2012 |
| KR | 10-2022909 | B1 | 9/2019 |
| KR | 10-2267982 | B1 | 6/2021 |
| RU | 1836038 | A3 | 8/1993 |
| WO | 93/20722 | A1 | 10/1993 |
| WO | 2019/130445 | A1 | 7/2019 |
| WO | 2019/130446 | A1 | 7/2019 |

OTHER PUBLICATIONS

Espacenet English Translation of CN 106522022 A (Year: 2024).*
Office Action dated Dec. 27, 202 from the Russian Patent Office in Application No. 2022117908/03(037739).
Office Action dated Dec. 12, 2022 from the Japanese Patent Office in Application No. 2021-562341.
Extended European Search Report dated Jul. 28, 2022 in Application No. 21799162.9.
International Search Report of PCT/KR2021/008431 dated Oct. 26, 2021 [PCT/ISA/210].

* cited by examiner

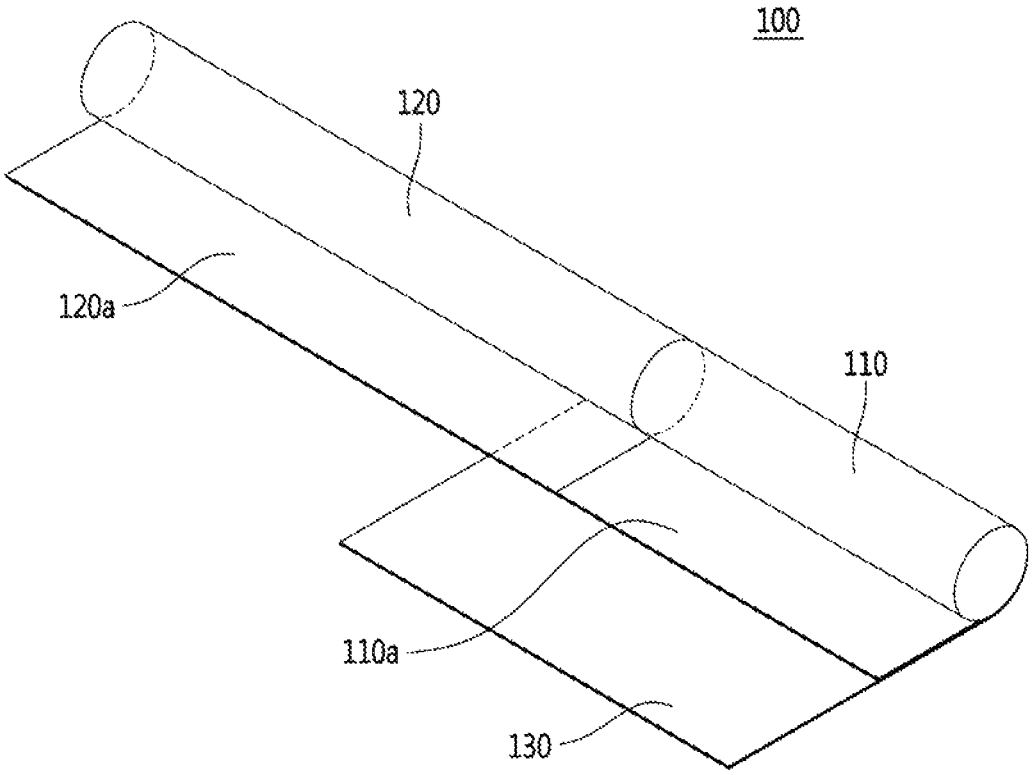
100
120
120a
110
110a
130

VANILLA SMOKING MATERIAL WRAPPER AND SMOKING ARTICLE INCLUDING THE SAME

CROSS REFERENCE TO RELATED APPLICATIONS

This application is a National Stage of International Application No. PCT/KR2021/008431 filed Jul. 2, 2021, claiming priority based on Korean Patent Application No. 10-2020-0084915 filed Jul. 9, 2020.

TECHNICAL FIELD

The present disclosure relates to a smoking material wrapper into which a vanilla scent is added and a smoking article including the same, and more particularly, to a cigar wrapper into which a vanilla scent is added, which is capable of reducing a sidestream smoke smell and imparting a low-irritation, soft tobacco smoke taste, and a smoking article including the same.

BACKGROUND ART

Tobacco smoke generated through smoking can be classified into mainstream smoke that is delivered to the mouth by passing through a tobacco filter and sidestream smoke that is released into the atmosphere without passing through the filter. Components that are included in the mainstream smoke and sidestream smoke and cause an undesirable smell may constitute environmental tobacco smoke (ETS) and adversely affect the smoker and those around the smoker.

Thus, there is a need to develop a smoking material wrapper capable of reducing a sidestream smoke smell and increasing satisfaction with smoking while allowing differentiation from existing cigarettes.

DISCLOSURE

Technical Problem

The present disclosure is directed to providing a differentiated cigarette paper, which reduces a sidestream smoke smell and imparts a low-irritation tobacco smoke taste, and a smoking article including the same.

Objectives of the present disclosure are not limited to the above-mentioned objective, and other unmentioned objectives should be clearly understood by those of ordinary skill in the art to which the present disclosure pertains from the description below.

Technical Solution

Some embodiments of the present disclosure provide a smoking material wrapper into which at least one vanilla material from among vanillin, ethyl vanillin, and ethyl vanillin glucoside and cigar fibers are added.

Here, the weight of the vanilla material added into the smoking material wrapper may be in a range of 0.5% to 10% of the total weight of the smoking material wrapper. Preferably, the weight of the vanilla material added into the smoking material wrapper may be in a range of 1% to 5% of the total weight of the smoking material wrapper. More preferably, the weight of the vanilla material added into the smoking material wrapper may be in a range of 2% to 4% of the total weight of the smoking material wrapper.

Meanwhile, the weight of the cigar fibers added into the smoking material wrapper may be in a range of 5% to 80% of the total weight of the smoking material wrapper. Preferably, the weight of the cigar fibers added into the smoking material wrapper may be in a range of 10% to 60% of the total weight of the smoking material wrapper. More preferably, the weight of the cigar fibers added into the smoking material wrapper may be in a range of 20% to 40% of the total weight of the smoking material wrapper.

In some embodiments, the weight of the vanilla material added into the smoking material wrapper may depend on the weight of the cigar fibers added into the smoking material wrapper.

The weight of the vanilla material added into the smoking material wrapper may be calculated by multiplying a reference coefficient by a value obtained by subtracting a reference constant from the weight of the cigar fibers. Here, the reference constant may be a real number in a range of 23 to 25, and the reference coefficient may be a real number in a range of 1 to 5.

Meanwhile, in the CIELAB color space, the smoking material wrapper may have an L* value in a range of 50 to 80, an a* value in a range of 1 to 15, and a b* value in a range of 20 to 30. Preferably, the L* value may be in a range of 50 to 60, the a* value may be in a range of 10 to 20, and the b* value may be in a range of 20 to 30. Alternatively, the L* value may be in a range of 65 to 80, the a* value may be in a range of 1 to 5, and the b* value may be in a range of 20 to 30.

Also, some embodiments of the present disclosure provide a smoking article including a smoking material portion wrapped with a smoking material wrapper, a filter portion whose upstream end is combined with the smoking material portion and which is wrapped with a filter wrapper, and a tipping wrapper wrapped around the filter portion and at least a partial area of the smoking material portion so that the smoking material portion and the filter portion are combined, wherein at least one vanilla material from among vanillin, ethyl vanillin, and ethyl vanillin glucoside and cigar fibers are added into the smoking material wrapper.

Advantageous Effects

According to embodiments of the present disclosure, since a vanilla material and cigar fibers are added into a smoking material wrapper, a tobacco smell of sidestream smoke can be reduced or masked with a vanilla scent to eliminate or reduce discomfort of the smoker or those around the smoker.

Also, the smoking material wrapper according to the present disclosure can provide a smoker with more preferable sensory characteristics while securing the above-mentioned sidestream smoke smell reduction effect.

Further, even when a vanilla material capable of securing sufficient scent retention and expression is added into the smoking material wrapper according to the present disclosure, it is possible to minimize a risk relating to discoloration of cigarette paper.

DESCRIPTION OF DRAWINGS

FIG. 1 is a view illustrating a schematic configuration of a smoking article according to some embodiments of the present disclosure.

MODES OF THE INVENTION

Hereinafter, exemplary embodiments of the present disclosure will be described in detail with reference to the accompanying drawings. Advantages and features of the present disclosure and methods of achieving the same should become clear with embodiments described in detail below with reference to the accompanying drawings. However, the present disclosure is not limited to the embodiments disclosed below and may be implemented in various other forms. The embodiments make the disclosure of the present disclosure complete and are provided to completely inform those of ordinary skill in the art to which the present disclosure pertains of the scope of the disclosure. The scope of the present disclosure is defined only by the scope of the claims. Like reference numerals refer to like elements throughout.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein.

Also, in the specification, a singular expression includes a plural expression unless the context clearly indicates otherwise. The terms "comprises" and/or "comprising" used herein do not preclude the possibility of the presence or addition of one or more elements, steps, operations, and/or devices other than those mentioned.

Terms including ordinals such as "first" or "second" used herein may be used to describe various elements, but the elements are not limited by the terms. The terms are only used for the purpose of distinguishing one element from another element.

Throughout the specification, "smoking article" may refer to anything capable of generating an aerosol, such as tobacco (cigarette) and cigars. The smoking article may include an aerosol-generating material or an aerosol-forming substrate. Also, the smoking article may include a solid material based on tobacco raw materials, such as reconstituted tobacco leaves, shredded tobacco, and reconstituted tobacco. A smoking material may include a volatile compound.

FIG. 1 is a view illustrating a schematic configuration of a smoking article according to some embodiments of the present disclosure.

In this specification, a smoking article 100 may refer to a combustion-type cigarette. However, in some cases, the smoking article 100 may also refer to a heating-type cigarette or the like that is used together with an aerosol generation device (not illustrated) such as an electronic cigarette device.

Referring to FIG. 1, the smoking article 100 may include a filter portion 110 wrapped with a filter wrapper 110*a*, a smoking material portion 120 wrapped with a smoking material wrapper 120*a*, and a tipping paper 130 configured to combine the filter portion 110 and the smoking material portion 120.

The filter portion 110 may be disposed downstream of the smoking material portion 120 and may be a region through which an aerosol material generated in the smoking material portion 120 passes right before being inhaled by the user.

The filter portion 110 may be made of various materials. For example, the filter portion 110 may be a cellulose acetate filter. The filter portion 110 may be a cellulose acetate filter not flavored with a flavoring material or a transfer jet nozzle system (TJNS) filter flavored with a flavoring material.

In some embodiments, the filter portion 110 may be a tubular structure including a hollow formed therein. The filter portion 110 may also be manufactured by inserting structures such as films or tubes made of the same or different materials thereinto (for example, into the hollow).

The filter portion 110 of the present embodiment is illustrated as a mono filter formed of a single filter, but the present disclosure is not limited thereto. For example, the filter portion 110 may, of course, be provided as a dual filter which includes two acetate filters, a triple filter, or the like in order to increase filter efficiency.

Further, although not illustrated, a crushable capsule (not illustrated), which has a structure in which a liquid filled therein including a flavoring is wrapped by a film, may be included inside the filter portion 110.

The filter portion 110 is disposed downstream of the smoking material portion 120 to serve as a filter through which an aerosol material generated in the smoking material portion 120 passes right before being inhaled by the user.

The filter portion 110 may be wrapped with the filter wrapper 110*a*. The filter wrapper 110*a* may be manufactured using grease-resistant wrapping paper, and an aluminum foil may be further included at an inner surface of the filter wrapper 110*a*.

The smoking material portion 120 may be filled with raw tobacco leaves, reconstituted tobacco leaves, or a mixture of tobacco leaves and reconstituted tobacco leaves. The mixture may be filled in the form of a sheet or shredded tobacco in the smoking material portion 120. The smoking material portion 120 may have the form of a longitudinally extending rod which may have various lengths, circumferences, and diameters. Also, the smoking material portion 120 may include at least one aerosol-generating material among glycerin, propylene glycol, ethylene glycol, dipropylene glycol, diethylene glycol, triethylene glycol, tetraethylene glycol, and oleyl alcohol. Also, the smoking material portion 120 may contain other additives such as a flavoring agent, a wetting agent, and/or an acetate compound.

The smoking material portion 120 may be wrapped with the smoking material wrapper 120*a*. Meanwhile, the amount of generated sidestream smoke, which may adversely affect the smoker and those around the smoker, may be influenced by the overall structure of the smoking article 100 or a mixture of tobacco leaves that may be included in the smoking material portion 120. In particular, the amount of generated sidestream smoke is significantly affected by characteristics of the smoking material wrapper 120*a* with which the smoking material portion 120 is wrapped. For this reason, conventionally, there have been various attempts to reduce sidestream smoke, such as constituting the smoking material wrapper 120*a* in the form of a double wrapper or changing characteristics of the smoking material wrapper 120*a* such as the fiber composition, porosity, filler type, particle distribution, and added amount thereof. However, in a case in which only the basis weight of the smoking material wrapper 120*a* is increased as compared to general cigarette paper in order to reduce sidestream smoke, the amount of used fibers may be increased, and thus a fiber smell and an off-taste may increase during smoking. For this reason, a tobacco smoke taste felt by the smoker during smoking may decrease, and thus there is a limitation in application of the above case to products.

Accordingly, in order to provide a differentiated cigarette paper which imparts a low-irritation, soft tobacco smoke taste while reducing a tobacco smell caused by sidestream smoke, a vanilla material and cigar fibers may be added into the smoking material wrapper 120*a* of the present disclosure.

Specifically, at least one vanilla material from among vanillin, ethyl vanillin, and ethyl vanillin glucoside may be added into the smoking material wrapper 120*a*, and simultaneously, cigar fibers extracted from cigars (cigar leaves) may be added into the smoking material wrapper 120*a*. In addition to the vanilla material and cigar fibers, cellulose fibers such as a bast fiber and wood pulp, inorganic fillers such as calcium carbonate, and combustion improvers such as ammonium phosphate may be included in the smoking material wrapper, but the present disclosure is not limited thereto.

Here, in consideration of vanilla scent retention during a storage period of cigarettes and the combustibility, tobacco smoke taste intensity, etc. of the cigarettes during smoking, the weight of the vanilla material added into the smoking material wrapper 120*a* may be in a range of about 0.5% to 10%, preferably, about 1% to 5%, and more preferably, about 2% to 4%, of the total weight of the smoking material wrapper.

As will be described in detail in the following experimental examples or the like, in a case in which the amount of added vanilla material is less than the above-mentioned numerical range, a favorable scent during smoking is degraded, making it difficult to reduce a tobacco smell significantly and secure stable scent retention during storage of cigarettes. Also, in a case in which the amount of added vanilla material exceeds the above-mentioned numerical range, combustibility of cigarettes is degraded such that the puff number excessively increases. Accordingly, a migration amount of nicotine per puff decreases and thus the tobacco smoke taste intensity and satisfaction with the tobacco smoke taste are degraded during smoking. Further, since an inherent scent of the vanilla material and an inherent tobacco taste do not blend harmoniously, the overall smoking satisfaction is also degraded.

Meanwhile, when only the vanilla material is added to the smoking material wrapper, apart from the favorable scent expression, problems such as a decrease in the tobacco smoke taste intensity, scent loss during a storage period of cigarettes, and discoloration of the wrapper over the storage period may occur.

In consideration of such aspects, cigar fibers may be added together with the vanilla material into the smoking material wrapper 120*a* of the present disclosure.

Specifically, the weight of the cigar fibers added into the smoking material wrapper 120*a* may be in a range of about 10% to 50%, preferably, about 20% to 40%, and more preferably, about 25% to 35%, of the total weight of the smoking material wrapper 120*a*.

In a case in which the cigar fibers in the above-mentioned range are added together with the vanilla material into the smoking material wrapper 120*a*, the discoloration issue of cigarettes may be addressed, satisfaction with inherent tobacco may be preserved, and simultaneously, a tobacco smell reduction effect due to scent retention and scent expression may be stably secured. The above-mentioned effects due to adding the cigar fibers were confirmed to be more prominent particularly in a case in which the vanilla material added to the smoking material wrapper 120*a* was about 3 wt % or more.

In some embodiments, the weight of the vanilla material added into the smoking material wrapper 120*a* may depend on the weight of the cigar fibers added into the smoking material wrapper 120*a*. That is, the amount of added vanilla material may be changed as the amount of added cigar fibers is changed. In other words, the amount of added cigar fibers may be changed as the amount of added vanilla material is changed.

Preferably, the vanilla material content (or the cigar fibers content) may be proportional to the cigar fibers content (or the vanilla material content). That is, when the vanilla material content (or the cigar fibers content) is increased, the cigar fibers content (or the vanilla material content) may also be increased.

As a specific example, the cigar fibers content (or the vanilla material content) may linearly increase with an increase in the vanilla material content (or the cigar fibers content). More specifically, the weight of the vanilla material added into the smoking material wrapper 120*a* may be calculated by multiplying a reference coefficient by a value obtained by subtracting a reference constant from the weight of the cigar fibers. That is, a weight V of the vanilla material added into the smoking material wrapper 120*a* and a weight C of the cigar fibers added into the smoking material wrapper 120*a* may have the relationship shown in Equation 1.

$$V = cf \times (C - ct) \quad \text{[Equation 1]}$$

In Equation 1, cf may represent the reference coefficient, and ct may represent the reference constant. Preferably, the reference constant may be a real number in a range of about 23 to 25, and the reference coefficient may be a real number in a range of about 1 to 5.

When the vanilla material content in the smoking material wrapper 120*a* and the cigar fibers content in the smoking material wrapper 120*a* have the above relationship, it is possible to further maximize an effect of improving the quality of mainstream smoke and sidestream smoke while minimizing deterioration of an inherent tobacco smoke taste characteristic.

Also, in order to minimize a cigarette paper discoloration issue in a cigarette manufacturing process, a cigarette storage period, and a cigarette distribution period at various temperatures and humidity levels, preferably, in the CIELAB color space, the smoking material wrapper 120*a*, into which the vanilla material and the cigar fibers are added, may have the L* value in a range of about 50 to 80, the a* value in a range of about 1 to 15, and the b* value in a range of about 20 to 30. More preferably, the L* value may be in a range of about 50 to 60, the a* value may be in a range of about 10 to 20, and the b* value may be in a range of about 20 to 30. Alternatively, the L* value may be in a range of about 65 to 80, the a* value may be in a range of about 1 to 5, and the b* value may be in a range of about 20 to 30.

Meanwhile, in order to improve the quality of mainstream smoke and sidestream smoke, allow differentiation from existing cigarettes, and also secure a tobacco smoke taste, combustibility, extinguishability, and manufacture workability of cigarettes by using the smoking material wrapper 120*a* of the present disclosure, preferably, the smoking material wrapper 120*a* of the present disclosure may contain a combustion improver at a range of about 1.0 wt % to 1.5 wt % and a filler at a range of about 12 wt % to 21 wt %.

Further, in order to secure the advantageous effects of the present disclosure under the above-listed conditions of the smoking material wrapper 120*a*, the smoking material wrapper 120*a* may have a tensile strength in a range of about 0.08 kgf/mm to 0.10 kgf/mm and elongation in a range of about 0.5% to 1.0%.

In some embodiments, the smoking material wrapper 120*a* may have a double wrapping paper structure. Specifically, the smoking material wrapper 120*a* may include an inner wrapper (not illustrated) that comes in contact with the smoking material portion 120 and is wrapped around the smoking material portion 120, and an outer wrapper that comes in contact with the inner wrapper and is wrapped around an outer portion of the inner wrapper.

In this case, any one of the inner wrapper and outer wrapper may be made of cigarette paper that does not contain the vanilla material and cigar fibers, and the other may be made of cigarette paper that contains the vanilla material and cigar fibers.

Alternatively, any one wrapper of the inner wrapper and outer wrapper may contain any one of the vanilla material and cigar fibers, and the other wrapper may contain the other of the vanilla material and cigar fibers.

The smoking material wrapper, which has the double wrapping paper structure containing the vanilla material and cigar fibers as described above, may have a more advantageous effect in terms of scent retention and sidestream smoke smell reduction characteristics.

Meanwhile, the smoking material wrapper 120*a* may be low ignition propensity (LIP) cigarette paper having one or more LIP bands (not illustrated) formed therein, but is not limited thereto.

The filter portion 110 wrapped with the filter wrapper 110*a* and the smoking material portion 120 wrapped with the smoking material wrapper 120*a* may be wrapped together by the tipping paper 130. That is, the tipping paper 130 may be wrapped around at least a portion (for example, a partial downstream area) of the smoking material wrapper 120*a* and an outer periphery of the filter wrapper 110*a*. In other words, the filter portion 110 and at least a portion of the smoking material portion 120 may be further wrapped with the tipping paper 130 and physically combined with each other. In some embodiments, the tipping paper 130 may be made of nonporous wrapping paper to which grease-resistant treatment is not done, but is not limited thereto.

Meanwhile, the tipping paper 130 may include an incombustible material and thus prevent combustion of the filter portion 110, but is not limited thereto.

Hereinafter, the configurations of the present disclosure and the advantageous effects according thereto will be described in more detail using examples and comparative examples. However, the examples are merely for describing the present disclosure in more detail, and the scope of the present disclosure is not limited by the examples.

Example 1

A cigarette paper wrapped around a shredded tobacco portion of a cigarette manufactured for testing of examples was removed, and a cigarette paper containing about 1 wt % of vanilla material and about 30 wt % of cigar fibers was wrapped around a shredded tobacco portion to manufacture a cigarette. A vanilla material including vanillin and ethyl vanillin at a ratio of about 1:1 was used, and the cigar fibers extracted from middle lobes of cigar leaves were used.

Example 2

A cigarette identical to that of Example 1 was manufactured except that a cigarette paper contained about 3 wt % of vanilla material.

Comparative Example 1

A cigarette identical to that of Example 1 was manufactured except that a cigarette paper did not contain a vanilla material.

Experimental Example 1: Evaluation of Physical Properties of Vanilla Cigar Wrapper In order to confirm physical properties of the cigarette paper according to the examples of the present disclosure, the porosity, basis weight, tensile strength, a combustion improver content, a filler content, and cigarette combustibility were analyzed for the cigarette paper of each example, and results of analysis are shown in Table 1. Table 2 shows results of analyzing whether the physical properties change over a storage period of the cigarette according to Example 1, and Table 3 shows the weight, circumference, dilution rate, unencapsulated pressure drop (UPD), encapsulated pressure drop (EPD), and hardness characteristics of the cigarettes.

TABLE 1

| Classification | | Porosity (CU) | Basis weight (gsm) | Tensile strength (kgf/15 mm) | Combustion improver (%) | Filler (%) | Combustibility (15 cm, sec) |
|---|---|---|---|---|---|---|---|
| Comparative Example 1 | 0% vanilla | 50 ± 20 | 46 ± 1.5 | 1.40 or more | 1.2 ± 0.1 | 22.0 ± 2.0 | 100 or less |
| Example 1 | 1% vanilla | 43 | 46.4 | 1.51 | 0.84 | 21.4 | 103 |
| Example 2 | 3% vanilla | 40 ± 8 | 43.8 | 1.3 ± 0.1 | 1.5 | 12.0 | 114 |

TABLE 2

| Classification | | | Porosity (CU) | Basis weight (gsm) | Tensile strength (kgf) | Combustion improver (%) | Filler (%) |
|---|---|---|---|---|---|---|---|
| Example 1 (1%) | Start of storage in warehouse | 0 weeks | 43 | 46.4 | 1.51 | 0.84 | 21.4 |
| | Under constant temperature and humidity conditions | 16 weeks | 42 | 45.6 | 1.41 | 0.91 | 21.6 |
| | Under harsh conditions | 16 weeks | 44 | 46.0 | 1.50 | 0.83 | 21.7 |

TABLE 3

| Classification | Weight (mg) | Circumference (mm) | Dilution rate (%) | UPD (mmH2O) | EPD (mmH2O) | Hardness (%) |
|---|---|---|---|---|---|---|
| Standard | 330 | 17.0 | 93 | 65 | — | — |
| Comparative Example 1 (0%) | 332 | 17.0 | 92.8 | 65 | 271 | 68.1 |
| Example 1 (1%) | 329 | 17.0 | 92.5 | 66 | 275 | 67.5 |
| Example 2 (3%) | 340 | 17.0 | 93 | 65 | 273 | 66.9 |

As shown in Tables 1 to 3, physical properties which render mass production unsuitable were not observed in any of the comparative example and the examples, and it can be seen that deterioration of the physical properties did not occur over a storage period for each condition.

Comparative Example 2

A cigarette identical to that of Example 1 was manufactured except that a cigarette paper did not contain cigar fibers.

Experimental Example 2: Storability of Vanilla Cigar Wrapper—Discoloration Evaluation In order to evaluate discoloration over a storage period, CIELAB color space data was measured for the cigarette paper of each example, and results of measurement are shown in Table 4.

TABLE 4

| Classifications | | Under constant temperature and humidity conditions (22° C., RH 60%) | | | Under harsh conditions (37° C., RH 70%) | | | Remarks |
|---|---|---|---|---|---|---|---|---|
| | | Color difference | | | Color difference | | | |
| Comparative Example 1 (0%) | Item | L | a | b | L | a | b | Change in color difference was measured as compared to the start of storage in a warehouse (change was within ± 16.0) |
| | 0 weeks | 47.4 | 9.7 | 16.2 | 47.4 | 9.7 | 16.2 | |
| | 16 weeks | 40.4 | 8.1 | 13.5 | 31.6 | 6.1 | 9.7 | |
| | Amount of change within 16 weeks | −7.0 | −1.6 | −2.7 | −15.8 | −3.6 | −6.5 | |
| Comparative Example 2 (1%) | Item | L | a | b | L | a | b | Change in color difference was measured as compared to the start of storage in a warehouse (change was within ± 8.0) |
| | 0 weeks | 97.0 | −0.1 | 3.9 | 97.0 | −0.1 | 3.9 | |
| | 16 weeks | 93.1 | 1.4 | −3.9 | 91.8 | 1.7 | 4.5 | |
| | Amount of change within 16 weeks | −3.9 | 1.5 | −7.8 | −5.2 | 1.8 | 0.6 | |
| Example 1 (1%) | Item | L | a | b | L | a | b | Change in color difference was measured as compared to the start of storage in a warehouse (change was within ± 3.0) |
| | 0 weeks | 52.7 | 13.2 | 22.7 | 52.7 | 13.2 | 22.7 | |
| | 16 weeks | 53.9 | 12.4 | 21.8 | 53.8 | 12.2 | 20.9 | |
| | Amount of change within 16 weeks | +1.2 | −0.8 | −0.9 | +1.1 | −1.0 | −1.8 | |
| Example 2 (3%) | Item | L | a | b | L | a | b | Change in color difference was measured as compared to the start of storage in a warehouse (change was within ± 6.0) |
| | 0 weeks | 75.3 | 3.0 | 25.6 | 75.3 | 3.0 | 25.6 | |
| | 16 weeks | 73.1 | 4.2 | 23.8 | 69.6 | 3.2 | 22.1 | |
| | Amount of change within 16 weeks | −2.2 | +0.2 | −1.8 | −5.7 | +0.2 | −3.5 | |

Referring to Table 4, in the case of Comparative Example 1, a change in a color difference value was observed to be within ±16.0 over a storage period, and the ΔE value under harsh conditions was calculated to be about 17.5. In the case of Example 1, a change in a color difference value was observed to be within ±3.0, and the ΔE value was calculated to be about 2.3 even under the harsh conditions. Thus, considering that, generally, a consumer can recognize a color change only when the ΔE value is 3 or more, it was confirmed that a discoloration issue would not occur during manufacture of the cigarette according to Example 1. Referring to the results of Comparative Example 1 in which the vanilla material content in the cigarette paper was the same as in Example 1 but the cigarette paper did not contain cigar fibers, it can be seen that, in Example 1, the amount of change in a color difference value was smaller and the ΔE value was lower as compared to Comparative Example 1. Further, in the case of Example 1, as indicators other than the CIELAB color space data shown in Table 4, whiteness and opacity characteristics were also confirmed as being superior as compared to Comparative Example 1. Specifically, in the case of Comparative Example 1, over the storage period, whiteness changed by about −8.9% (about −12.4% under the harsh conditions) and opacity changed by about 7.4% (about 8.7% under the harsh conditions), but in the case of Example 1, even under the harsh conditions, the amount of change in whiteness (about 2% under the harsh conditions) and the amount of change in opacity (about 3% under the harsh conditions) were found to be smaller as compared to Comparative Example 1 where the temperature and the humidity were constant. Thus, it was found that containing the vanilla material and cigar fibers as in the above examples is advantageous for minimizing discoloration.

In the case of Example 2, change in a color difference value was observed to be within ±6.0, and the ΔE value was calculated to be about 1.6 under the constant temperature and humidity conditions and about 6.7 under the harsh conditions. Thus, it was confirmed that a discoloration issue would not occur during general storage and distribution of the cigarette manufactured according to Example 2.

Experimental Example 3: Evaluation of Manufacture Workability of Vanilla Cigar Wrapper To evaluate workability during manufacture of a cigarette to which a vanilla cigar wrapper is applied, an applicable manufacturing speed, adhesive properties, whether breakage of cigarette paper occurred, whether contamination due to an adhesive occurred, and an extinguishing rate were evaluated for the cigarette paper of each example, and results of evaluation are shown in Table 5.

TABLE 5

| Cigarette paper | Manufacturing speed (CPM) | Adhesive properties | Breakage of cigarette paper | Contamination due to adhesive | Extinguishing rate |
|---|---|---|---|---|---|
| Comparative Example 1 (0%) | 3,200 | Good | No | No | 100% |
| Example 1 (1%) | 3,200 | Good | No | No | 100% |
| Example 2 (3%) | 3,400 | Good | No | No | 100% |

As shown in Table 5, it can be seen that, in terms of the speed and workability of manufacturing cigarettes, there was no significant difference according to whether the vanilla material was added.

Experimental Example 4: Evaluation of Components of Smoke

For analysis of components of mainstream smoke and sidestream smoke for each example, mainstream smoke and sidestream smoke generated during smoking of each of the cigarettes were collected. The smoke was repeatedly collected three times for each sample, and 70 mL of sidestream smoke and 20 mL of mainstream smoke were collected each time. The component analysis results based on the average values of three collection results are shown in Table 6 and Table 7. The cigarettes were tested according to Health Canada (HC) smoking conditions using an automatic smoking device in a smoking room with a temperature of about 20° C. and humidity of about 62.5%.

TABLE 6

| | Mainstream smoke | | | | | | Sidestream smoke | |
|---|---|---|---|---|---|---|---|---|
| Classification | Tar (mg/cig) | Nicotine (mg/cig) | CO (mg/cig) | Vanillin (μg/cig) | Ethyl vanillin (μg/cig) | Puff number | Vanillin (μg/cig) | Ethyl vanillin (μg/cig) |
| Comparative Example 1 (0%) | 1.13 | 0.11 | 0.76 | 3.74 | 1.96 | 7.88 | 18.85 | 7.70 |
| Example 1 (1%) | 1.03 | 0.10 | 0.78 | 3.79 | 2.16 | 7.85 | 21.89 | 11.99 |
| Example 2 (3%) | 1.08 | 0.08 | 0.75 | 3.81 | 2.31 | 7.90 | 25.11 | 14.10 |

Referring to Table 6, in both examples, detection values of major smoke components such as tar, nicotine, and carbon monoxide were found to be close to those in the comparative example, and it can be seen that the amount of vanillin and ethyl vanillin in mainstream smoke slightly increased in both examples as compared to the comparative example. Referring to the results of component analysis of sidestream smoke, in both examples, an amount of increase in vanilla component was found to be larger than an amount of increase in vanilla component in the mainstream smoke. In particular, in Example 2 in which the vanilla component was contained at 3%, an amount of vanillin increased by 30% or more and an amount of ethyl vanillin increased by 80% or more as compared to Comparative Example 1, and thus a vanilla scent expression effect by the sidestream smoke was confirmed.

TABLE 7

| Classification | | Vanillin + Ethyl Vanillin (μg/cig) | | | |
|---|---|---|---|---|---|
| | | Mainstream smoke | | Sidestream smoke | |
| | | Constant temperature and humidity conditions (22° C., RH 60%) | Harsh conditions (37° C., RH 70%) | Constant temperature and humidity conditions (22° C., RH 60%) | Harsh conditions (37° C., RH 70%) |
| Comparative Example 1 (0%) | Week 2 | 5.70 | 5.70 | 26.55 | 26.55 |
| | Week 4 | 5.54 | 3.60 | 20.58 | 18.13 |
| | Week 16 | 2.58 | 1.27 | 17.15 | 12.70 |
| | Decrease amount (Decrease rate) | 3.12 (54.7%) | 4.43 (77.7%) | 9.40 (35.4%) | 13.85 (52.2%) |
| Example 1 (1%) | Week 2 | 5.92 | 5.92 | 33.88 | 33.88 |
| | Week 4 | 5.58 | 3.98 | 28.84 | 24.15 |
| | Week 16 | 2.40 | 1.62 | 20.76 | 15.05 |
| | Decrease amount (Decrease rate) | 3.52 (59.5%) | 4.30 (72.6%) | 13.12 (38.7%) | 18.83 (55.6%) |
| Example 2 (3%) | Week 2 | 15.05 | 15.60 | 101.71 | 108.27 |
| | Week 4 | 16.20 | 13.29 | 98.22 | 94.64 |
| | Week 16 | 11.88 | 8.05 | 58.99 | 54.07 |
| | Decrease amount (Decrease rate) | 3.17 (21.1%) | 7.55 (48.4%) | 42.72 (42.0%) | 54.2 (50.1%) |

Referring to Table 7, in both examples, the amount of expressed vanilla component generally increased as compared to the comparative example, and further, it can be seen that loss of the vanilla component during a storage period of cigarettes also decreased overall. In particular, in the case of Example 2, it can be seen that an absolute amount of expressed scent increased and a decrease rate of an amount of expressed vanilla component in the mainstream smoke and sidestream smoke during the storage period noticeably decreased as compared to Comparative Example 1.

Experimental Example 5: Evaluation of Reduction of Tobacco Smell Indicators

For each example, to verify effects of reducing sidestream smoke smell, a tobacco smell on fingers, and bad breath, component amounts of nicotine, 3-ethyl pyridine, 3-ethenyl pyridine, and pyridine, which are tobacco smell-related components, were analyzed, and results of analysis are shown in Table 8. The cigarettes were tested according to Health Canada (HC) smoking conditions using a sidestream smoke smoking device in a smoking room with a temperature of about 20° C. and humidity of about 62.5%, and analysis was performed by solid-phase microextraction followed by gas chromatography-mass spectrometry (SPME-GC/MS) on the collected sidestream smoke.

TABLE 8

| Classification | Component amount (Decrease rate) | | | |
|---|---|---|---|---|
| | Nicotine | 3-Ethyl pyridine | 3-Ethenyl pyridine | Pyridine |
| Comparative Example 1 (0%) | 59,802,095 | 844,618 | 8,922,727 | 438,163 |
| Example 1 (1%) | 51,123,387 (14.5%) | 592,982 (29.8%) | 5,556,744 (37.7%) | 412,205 (5.9%) |

TABLE 8-continued

| Classification | Component amount (Decrease rate) | | | |
|---|---|---|---|---|
| | Nicotine | 3-Ethyl pyridine | 3-Ethenyl pyridine | Pyridine |
| Example 2 (3%) | 47,644,531 (20.3%) | 511,564 (39.4%) | 4,655,641 (47.8%) | 356,492 (18.6%) |

As shown in Table 8, it can be seen that the amount of the tobacco smell indicators decreased in both examples, and accordingly, the sidestream smoke smell reduction effect can be expected in both examples. In particular, it can be seen that, in Example 2 in which the vanilla component was added at about 3%, the effect of reducing 3-ethyl pyridine, 3-ethenyl pyridine, and pyridine components, which may cause an unpleasant smell such as a tobacco smell and a foul smell, was prominent and thus the sidestream smoke smell reduction effect was further maximized.

Experimental Example 6: Sensory Evaluation of Smoking of Vanilla Cigar Wrapper

To confirm an effect of improving sensory characteristics of the vanilla cigar wrapper, sensory evaluation was performed on a degree of sweet external scent of a cigarette portion, a tobacco smoke taste intensity, irritation, an overall tobacco taste, an off-taste, a degree of sweet scent of sidestream smoke, an unpleasant smell of sidestream smoke, and a degree of receiving sidestream smoke for the examples. The sensory evaluation was carried out by a panel of sixteen evaluators using each of the cigarettes manufactured according to the examples, based on a scale of 7 points. Table 9 shows results of sensory evaluation of mainstream smoke, and Table 10 shows results sensory evaluation of sidestream smoke.

TABLE 9

| | Sensory evaluation of mainstream smoke | | | | | | |
|---|---|---|---|---|---|---|---|
| Classification | Storage period/ conditions | | Sweet external scent of cigarette portion | Tobacco smoke taste intensity | Irritation | Overall tobacco taste | Off-taste |
| Comparative Example 1 | 4 weeks | Constant temperature and humidity | 4.1 | 5.1 | 5.3 | 4.5 | 4.9 |
| | | Harsh | 3.8 | 4.7 | 5.2 | 4.7 | 5.2 |
| | 16 weeks | Constant temperature and humidity | 3.8 | 4.8 | 5.5 | 4.4 | 5.5 |
| | | Harsh | 3.8 | 4.7 | 5.7 | 4.3 | 5.8 |
| Example 1 (1%) | 4 weeks | Constant temperature and humidity | 4.6 | 5.2 | 5.1 | 4.7 | 4.5 |
| | | Harsh | 4.5 | 5.0 | 5.1 | 4.6 | 4.8 |
| | 16 weeks | Constant temperature and humidity | 4.2 | 5.1 | 5.2 | 4.5 | 4.9 |
| | | Harsh | 4.2 | 4.9 | 5.3 | 4.5 | 4.8 |
| Example 2 (3%) | 4 weeks | Constant temperature and humidity | 4.7 | 5.0 | 4.5 | 5.1 | 4.3 |
| | | Harsh | 4.8 | 4.7 | 4.6 | 5.3 | 4.6 |
| | 16 weeks | Constant temperature and humidity | 4.7 | 4.9 | 4.4 | 5.3 | 4.4 |
| | | Harsh | 4.5 | 4.7 | 4.5 | 5.4 | 4.5 |

Referring to Table 9, it can be seen that, in Example 1 in which the added vanilla material was about 1%, despite some differences according to the storage period and/or storage conditions, the intensity of sweet external scent increased overall, the irritation and off-taste showed a decreasing trend, and the tobacco smoke taste intensity and overall tobacco taste also increased overall, although relatively less prominent. In Example 2 in which the added vanilla material was about 3%, all sensory characteristics of mainstream smoke, except for the tobacco smoke taste intensity thereof, were found to be noticeably improved as compared to Comparative Example 1 and Example 1. Thus, it can be seen that the mainstream smoke improvement effect was the greatest in Example 2.

TABLE 10

| | Sensory evaluation of sidestream smoke | | | | |
|---|---|---|---|---|---|
| Classification | Storage period/conditions | | Intensity of sweet scent of sidestream smoke | Unpleasant smell of sidestream smoke | Degree of receiving sidestream smoke |
| Comparative | 4 weeks | Constant temperature and humidity | 3.1 | 5.1 | 4.5 |
| Example 1 | 16 weeks | Harsh | 3.2 | 5.2 | 4.6 |
| | | Constant temperature and humidity | 3.2 | 5.3 | 4.4 |
| | | Harsh | 3.0 | 5.5 | 4.2 |
| Example 1 (1%) | 4 weeks | Constant temperature and humidity | 4.5 | 4.7 | 5.1 |
| | | Harsh | 4.4 | 4.7 | 5.1 |

TABLE 10-continued

| Classification | Storage period/conditions | | Sensory evaluation of sidestream smoke: Intensity of sweet scent of sidestream smoke | Unpleasant smell of sidestream smoke | Degree of receiving sidestream smoke |
|---|---|---|---|---|---|
| | 16 weeks | Constant temperature and humidity | 4.1 | 4.8 | 4.7 |
| | | Harsh | 4.3 | 4.9 | 4.6 |
| Example 2 (3%) | 4 weeks | Constant temperature and humidity | 5.1 | 4.2 | 5.2 |
| | | Harsh | 5.3 | 4.3 | 5.1 |
| | 16 weeks | Constant temperature and humidity | 5.2 | 4.5 | 5.1 |
| | | Harsh | 5.0 | 4.5 | 5.3 |

Referring to Table 10, it can be seen that, in both Examples 1 and 2, the intensity of sweet scent of sidestream smoke and degree of receiving sidestream smoke were higher and the unpleasant smell of sidestream smoke reduced as compared to Comparative Example 1. From the results shown in Table 9 and Table 10, the sidestream smoke improvement effect was found to be greater than the mainstream smoke improvement effect in the case of Example 1 while both the mainstream smoke improvement effect and the sidestream smoke improvement effect were prominent in the case of Example 2. Meanwhile, although not disclosed in the above examples and experimental examples, in a case in which the amount of vanilla material added into the smoking material wrapper is increased to 5% or more, sensory characteristics other than the discoloration issue and tobacco smell reduction should be additionally taken into consideration.

Example 3

A cigarette identical to that of Example 1 was manufactured except that a cigarette paper contained about 5 wt % of vanilla material.

Example 4

A cigarette identical to that of Example 3 was manufactured except that a cigarette paper contained about 27 wt % of cigar fibers.

Example 5

A cigarette identical to that of Example 3 was manufactured except that a cigarette paper contained about 33 wt % of cigar fibers.

Experimental Example 7: Storability of Vanilla Cigar Wrapper—Discoloration Evaluation In order to evaluate discoloration according to the amount of added vanilla material and cigar fibers, CIELAB color space data was measured for the cigarette paper of Examples 3 to 5, and results of measurement are shown in Table 11.

TABLE 11

| Classifications | | Under constant temperature and humidity conditions (22° C., RH 60%) Color difference | | | Under harsh conditions (37° C., RH 70%) Color difference | | | Remarks |
|---|---|---|---|---|---|---|---|---|
| Example 3 (5% vanilla + 30% cigar fibers) | Item | L | a | b | L | a | b | Change in color difference was measured as compared to the start of storage in a warehouse (change was within ± 8.0) |
| | 0 weeks | 77.2 | 6.2 | 28.1 | 77.2 | 6.2 | 28.1 | |
| | 16 weeks | 74.4 | 6.9 | 24.3 | 69.5 | 7.3 | 24.1 | |
| | Amount of change within 16 weeks | −2.8 | 0.7 | −3.8 | −7.7 | 1.1 | −4.0 | |
| Example 4 (5% vanilla + 27% cigar fibers) | Item | L | a | b | L | a | b | Change in color difference was measured as compared to the start of storage in a warehouse (change was within ± 11.0) |
| | 0 weeks | 79.5 | 17.1 | 19.5 | 79.5 | 17.1 | 19.5 | |
| | 16 weeks | 74.0 | 18.2 | 15.0 | 68.9 | 18.4 | 13.5 | |
| | Amount of change within 16 weeks | −5.5 | 1.1 | −4.5 | −10.6 | 1.3 | −6.0 | |
| Example 5 (5% vanilla + 33% cigar fibers) | Item | L | a | b | L | A | b | Change in color difference was measured as compared to the start of storage in a |
| | 0 weeks | 69.3 | 2.2 | 20.9 | 69.3 | 2.2 | 20.9 | |
| | 16 weeks | 68.8 | 1.9 | 19.4 | 64.7 | 0.7 | 18.1 | |
| | Amount of change | −0.5 | −0.3 | −1.5 | −4.6 | −1.5 | −2.8 | |

TABLE 11-continued

| Classifications | Under constant temperature and humidity conditions (22° C., RH 60%) Color difference | Under harsh conditions (37° C., RH 70%) Color difference | Remarks |
|---|---|---|---|
| within 16 weeks | | | warehouse (change was within ± 5.0) |

Referring to Table 11, in the case of Example 3 in which the contained cigar fibers were about 30%, a change in a color difference value was observed to be within ±8.0 over the storage period, and the ΔE value under harsh conditions was calculated to be about 8.7. In the case of Example 4 in which the contained cigar fibers were about 27%, a change in a color difference value was observed to be within ±11.0, and the ΔE value under the harsh conditions was calculated to be about 12.2. In the case of Example 5 in which the contained cigar fibers were about 33%, a change in a color difference value was observed to be within ±5.0, and the ΔE value under harsh conditions was calculated to be about 5.6. From results of the discoloration evaluation of the above examples and cigarettes containing more than 5% of vanilla material, it was confirmed that, assuming other conditions were identical, the amount of change in a color difference value generally increased in the case in which more than 5% of vanilla material was added. Also, it was confirmed that, in order to reduce a degree of discoloration, the amount of added cigar fibers should be appropriately changed according to a change in the amount of added vanilla material. More specifically, in order to address or reduce the discoloration issue, it is preferable to increase the cigar fibers content according to an increase in the vanilla material content.

Experimental Example 8: Sensory Evaluation of Smoking of Vanilla Cigar Wrapper

To confirm an effect of improving sensory characteristics according to the amount of added vanilla material and cigar fibers, evaluation was performed on sensory characteristics of mainstream smoke and sensory characteristics of sidestream smoke for each example, and results of evaluation are shown in Table 12. The sensory evaluation was carried out by a panel of eleven evaluators using the cigarettes according to each example that were stored for sixteen weeks under the harsh conditions, based on a scale of 7 points.

Referring to Table 12, there was no significant different according to the cigar fibers content in terms of a sweet external scent of a cigarette portion, irritation, an intensity of a sweet scent of sidestream smoke, an unpleasant smell of sidestream smoke, and a degree of receiving sidestream smoke. However, differences were found between the examples in terms of a tobacco smoke taste intensity, an overall tobacco taste, and an off-taste. Specifically, it can be seen that, in Example 4 in which the added cigar fibers were about 27%, the tobacco smoke taste intensity and overall tobacco taste somewhat decreased and the off-taste slightly increased as compared to Example 3. On the other hand, it can be seen that, in Example 5 in which the added cigar fibers were about 33%, the tobacco smoke taste intensity and overall tobacco taste increased and the off-taste decreased as compared to Examples 3 and 4. From the above results of discoloration evaluation and sensory evaluation, it can be seen that, when the added vanilla material is about 5%, the most advantageous effects were obtained when the added cigar fibers were about 33%. That is, it can be seen that, in a case in which the amount of added vanilla material is changed, also changing the amount of added cigar fibers is advantageous for further maximizing the above-described effects of the present disclosure. Those of ordinary skill in the art related to the present embodiments should understand that the present disclosure may be implemented in modified forms within the scope not departing from essential characteristics of the above description. Therefore, the methods disclosed herein should be considered as illustrative rather than limiting. The scope of the present disclosure is defined by the claims below rather than by the above description, and all differences within the scope equivalent to the claims should be interpreted as falling within the scope of the present disclosure.

What is claimed is:

1. A smoking material wrapper for wrapping a smoking material portion of a smoking article, comprising:

vanilla material including vanillin and ethyl vanillin; and

TABLE 12

| Classification | Sensory evaluation of mainstream smoke: Sweet external scent of cigarette portion | Tobacco smoke taste intensity | Irritation | Overall tobacco taste | Off-taste | Sensory evaluation of side stream smoke: Intensity of sweet scent of sidestream smoke | Unpleasant smell of sidestream smoke | Degree of receiving sidestream smoke |
|---|---|---|---|---|---|---|---|---|
| Example 3 | 4.8 | 4.7 | 4.5 | 4.8 | 4.7 | 5.5 | 4.2 | 5.3 |
| | 4.7 | 4.5 | 4.6 | 4.9 | 4.7 | 5.4 | 4.4 | 5.1 |
| Example 4 | 4.5 | 4.1 | 4.6 | 4.6 | 5.1 | 5.2 | 4.3 | 5.1 |
| | 4.6 | 4.2 | 4.4 | 4.5 | 5.2 | 5.4 | 4.5 | 5.0 |
| Example 5 | 4.7 | 5.3 | 4.3 | 4.9 | 4.1 | 5.3 | 4.6 | 5.4 |
| | 4.9 | 5.1 | 4.5 | 5.0 | 4.3 | 5.6 | 4.5 | 5.4 |

tobacco fibers, wherein a weight of the vanilla material included in the smoking material wrapper is 3% of a total weight of the smoking material wrapper, and wherein the tobacco fiber is extracted from middle lobes of cigar leaves.

2. The smoking material wrapper of claim 1, wherein a weight of the tobacco fibers included in the smoking material wrapper is in a range of 20% to 40% of the total weight of the smoking material wrapper.

3. The smoking material wrapper of claim 1, wherein, in a CIELAB color space, the smoking material wrapper has an L* value in a range of 50 to 80, an a* value in a range of 1 to 15, and a b* value in a range of 20 to 30.

4. The smoking material wrapper of claim 3, wherein the L* value is in a range of 50 to 60, the a* value is in a range of 10 to 20, and the b* value is in a range of 20 to 30.

5. The smoking material wrapper of claim 3, wherein the L* value is in a range of 65 to 80, the a* value is in a range of 1 to 5, and the b* value is in a range of 20 to 30.

6. A smoking article comprising:

a smoking material portion wrapped with a smoking material wrapper;

a filter portion whose upstream end is combined with the smoking material portion and which is wrapped with a filter wrapper; and a tipping wrapper wrapped around the filter portion and at least a partial area of the smoking material portion such that the smoking material portion and the filter portion are combined, wherein the smoking material wrapper includes tobacco fibers and vanilla material including vanillin and ethyl vanillin, wherein a weight of the vanilla material included in the smoking material wrapper is 3% of a total weight of the smoking material wrapper, and wherein the tobacco fiber is extracted from middle lobes of cigar leaves.

* * * * *